US006117031A

United States Patent [19]

Malinauskas et al.

[11] Patent Number: 6,117,031

[45] Date of Patent: Sep. 12, 2000

[54] KICKBALL INFORMATION DELIVERY SYSTEM

[75] Inventors: Adam D. A. Malinauskas, New Providence, N.J.; Jeremy W. Bristol, Troy, N.Y.; Robert J. Goodell, Willamstown, Mass.; Hilary L. Gutman, Troy, N.Y.; Edward S. Hendricks, Cheshire, Mass.; David M. Steck, Troy; William Foley, Clifton Park, both of N.Y.

[73] Assignee: Rensselaer Polytechnic Institute, Troy, N.Y.

[21] Appl. No.: 09/203,917

[22] Filed: Dec. 2, 1998

[51] Int. Cl.[7] ..... A63B 37/00

[52] U.S. Cl. ..... 473/570; 473/415; 473/212; 273/DIG. 27

[58] Field of Search ..... 473/415–422, 473/451, 468, 353, 570, 598–601; 273/440, DIG. 27; 434/255

[56] References Cited

U.S. PATENT DOCUMENTS

| | | | |
|---|---|---|---|
| 4,212,116 | 7/1980 | Hajduch | 273/DIG. 27 |
| 4,270,751 | 6/1981 | Lowy | 273/DIG. 27 |
| 4,309,031 | 1/1982 | O'Meara | 473/415 |
| 5,316,293 | 5/1994 | Hamilton | 473/570 |
| 5,324,038 | 6/1994 | Sasser | 473/212 |
| 5,423,549 | 6/1995 | Englmeier | 473/570 |
| 5,564,698 | 10/1996 | Honey et al. | 473/570 |

*Primary Examiner*—Jeanette Chapman
*Assistant Examiner*—Mitra Aryanpour
*Attorney, Agent, or Firm*—Francis C. Hand, Esq.; Carella, Byrne Bain, Gilfillan, Cecchi, Stewart & Olstein

[57] ABSTRACT

The kickball information delivery system employs a ball having an internally disposed device for emitting a first sound location signal, a base transmitter unit for emitting a second sound location signal as well as a signal and an information unit to be mounted on a person for emitting a third pulsed sound signal to indicate the location of the person. In addition, the information unit is able to receive the signal and to use the reception of the signal to change the pulse frequency of the third sound signal to indicate alignment with the signal, for example to permit running from home plate to first base.

23 Claims, 6 Drawing Sheets

KICKBALL INFORMATION DELIVERY SYSTEM

This invention relates to a kickball information delivery system. More particularly, this invention relates to a personal orientation device particularly for use by visually impaired or blind individuals.

As is known, sports serve as an important source of social interaction and physical health especially among young people. However, due to various impairments, many people have been unable to participate in some sports. In particular, sports activities such as kickball and the like have not been available to people who are visually impaired.

People are normally able to orient themselves to their surroundings. However, in some cases, this is not possible where the individual is unable to obtain a true image of their surroundings. This may be as a result of weather conditions, such as fog, or possibly the location of an object in the line of sight of the person. In the case of people having very poor vision or those who are completely unable to see, these people have a much more difficult time with the task of personal orientation. As a result, routine events in the lives of the visually impaired are much more difficult than for people with normal sight.

Various attempts have been made to aid people who are visually impaired with personal orientation. In some cases, the approaches which have been used deprive the visually impaired of their independence.

U.S. Pat. No. 4,991,126 describes a system to orient a user to a point of origin. The system is intended to use measurements of direction and distance traveled to calculate the original location from the current location of the user. An internal distance and direction signal is to be used to make these calculations. Generally, such a device would be useful to aid a person in returning to an origin but does not aid the person in moving to a location independent of the origin.

U.S. Pat. No. 4,322,744 describes the use of a sound based signal to aid in personal orientation. As described, a reflected sound is to be used to provide sound feedback.

U.S. Pat. Nos. 4,593,273 and 4,675,656 each describe an out-of-range monitor and alarm system. The system is described as comprising a base unit for generating a first signal and an alarm which is operative to produce an alarm signal upon the detection of a second signal. In addition, a mobile unit is described having means for detecting the first signal and for generating a threshold output signal when the first signal falls below a predetermined signal strength. In addition, a means is coupled to the threshold circuitry for generating the second signal in response to the threshold output signal. In part, the threshold output signal is generated based on the level of alignment between the direction from a second means moving toward a first means and the direction to which the second means is moving.

U.S. Pat. No. 4,785,291 describes a distance monitor especially for child surveillance. As described, movement of the object beyond a predetermined range is immediately detected by the receiver location.

U.S. Pat. No. 5,714,932 describes a radio frequency security system with a direction and distance locator. As described, the orientation and direction between a central control unit and a portable transmitter unit is accomplished by a microprocessor to determine a relative position and a distance to the relative position.

It is an object of the invention to allow visually impaired kickball players to have direct interaction with sighted players.

It is another object of the invention to provide a technological aid for visually impaired persons that requires minimal training to put into use.

It is another object of the invention to provide a technical aid for visually impaired persons which is of minimal expense.

It is another object of the invention to provide equipment for playing kickball for visually impaired persons which is durable and long-lasting.

It is another object of the invention to provide a technological aid which can be used under a wide variety of conditions by visually impaired persons.

It is another object of the invention to enable visually impaired persons to play games such as kickball.

Briefly, the invention provides various components to enable a visually impaired person to participate in a sporting activity. More particularly, the invention provides components which emit sound signals to enable users to participate in a sport such as kickball.

The invention provides a ball having an internally disposed device for emitting a sound signal in order to provide a means for locating the ball. In addition, the invention provides a base transmitter unit having a first electronic circuit for emitting a sound location signal and a second electronic circuit for emitting a signal.

Still further, the invention provides an information unit which is to be mounted on a person and includes an electronic circuit for emitting a pulsed sound signal sufficient for all players in the game to hear as well as means for changing the pulse frequency of the signal in response to receiving the signal from the base transmitter unit.

These components, when used together, serve as a kickball information delivery system which allows visually impaired people to play kickball. The system uses a set of sounds to provide audio cues about the field and to the players on the field since visual cues cannot be used.

The information delivery system allows players to locate bases, provides a means to guide runners from base to base and helps players locate and keep track of the ball. In addition, the system allows fielders to find runners.

Advantageously, the system provides rules and creates the structure for an enjoyable game that visually impaired players might not otherwise experience.

The sounds which are used in the system serve various functions in a way so as to not interfere with each other for the enjoyment of the game. Each sound is employed to accomplish these effects.

The ball is constructed, for example, of a foam material and the device for emitting the sound signal includes an electronic circuit for emitting the signal. Typically, the device is disposed centrally within the ball and a pair of symmetrically displaced tubes are also disposed within the ball with each tube extending from the device towards an exterior surface of the ball for transmitting the sound signal from the device to the external surface of the ball.

The electronic circuit which is employed in the ball includes a timer chip for emitting a consistent repeated sound signal of predetermined pitch and frequency. In addition, the electronic circuit is constructed to indicate when the ball changes direction so that players will know to adjust. In this respect, the constant buzz of the signal can be switched to a higher pitched sound when the ball changes direction. To this end, the electronic circuit is provided with a resistance, a switch for selectively connecting the resistance to the timer chip in order to change the pitch of the sound signal and an acceleration sensing device, such as a spring, which is connected to the switch to close the switch in order to connect the resistance to the timer chip in response to a rapid acceleration of the ball.

The base transmitter unit is constructed to emit a pulsed tone signal as the sound location signal. This base sound signal provides a means for orientation. Since the source of this signal does not move, the signal need not be constant and may be pulsed, for example at two second intervals. In order to play a game of kickball, four base transmitter units are required to represent home base, first base, second base and third base.

The tone signal of the information unit, which is mounted on the runner, serves to indicate to fielders the location of the runner. In addition, this tone signal is used to guide the runner from base to base. In this respect, the tone signal is characterized as a beep that varies in frequencies based upon the runner's heading and the direction of the base. The information unit also includes a receiver for receiving the signal beam from the base transmitter unit and circuitry for increasing the output frequency of the low frequency tone signal in response to reception of the signal beam.

When in use, after a person has kicked the ball and desires to run to the first base, the person rotates in place until hearing the low frequency tone signal increase. The runner then knows that he/she is aligned in a straight line with the base transmitter unit at first base or if the person turns too much, the signal is lost and the frequency of the tone signal drops back to normal.

Once the runner has reached the base transmitter unit at first base, the faster tone signal that guided the runner to the base transmitter unit will have disappeared suddenly because the runner is so close to the transmitter unit that the signal beam is no longer received. In this respect, a mat is disposed in surrounding relation and overlying relation to the base transmitter unit so that a runner would feel the mat with his/her feet when getting close enough.

These and other objects and advantages of the invention will become more apparent from the following detailed description taken in conjunction with the accompanying drawings wherein.

Figure 4:
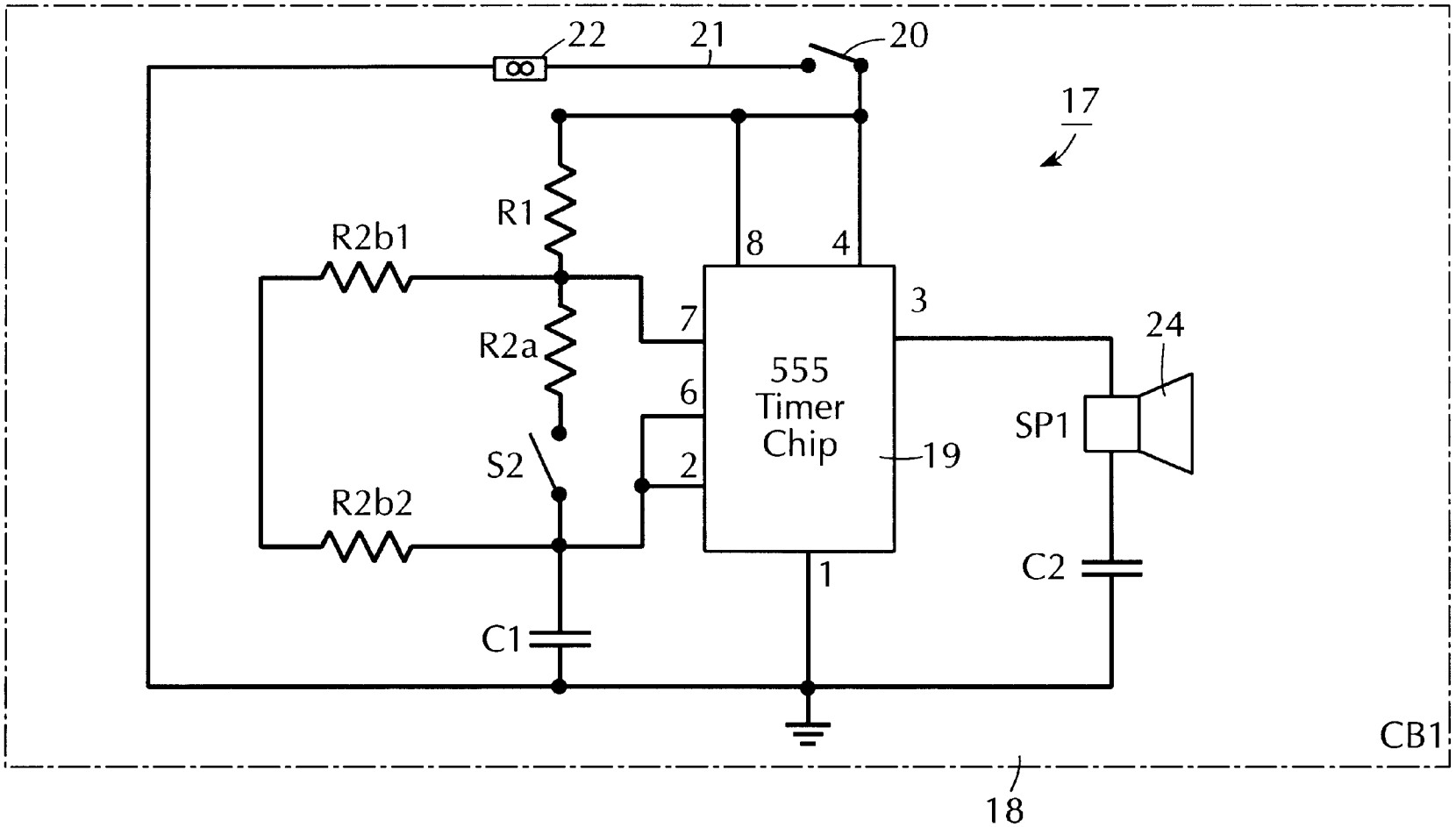
Figure 5:
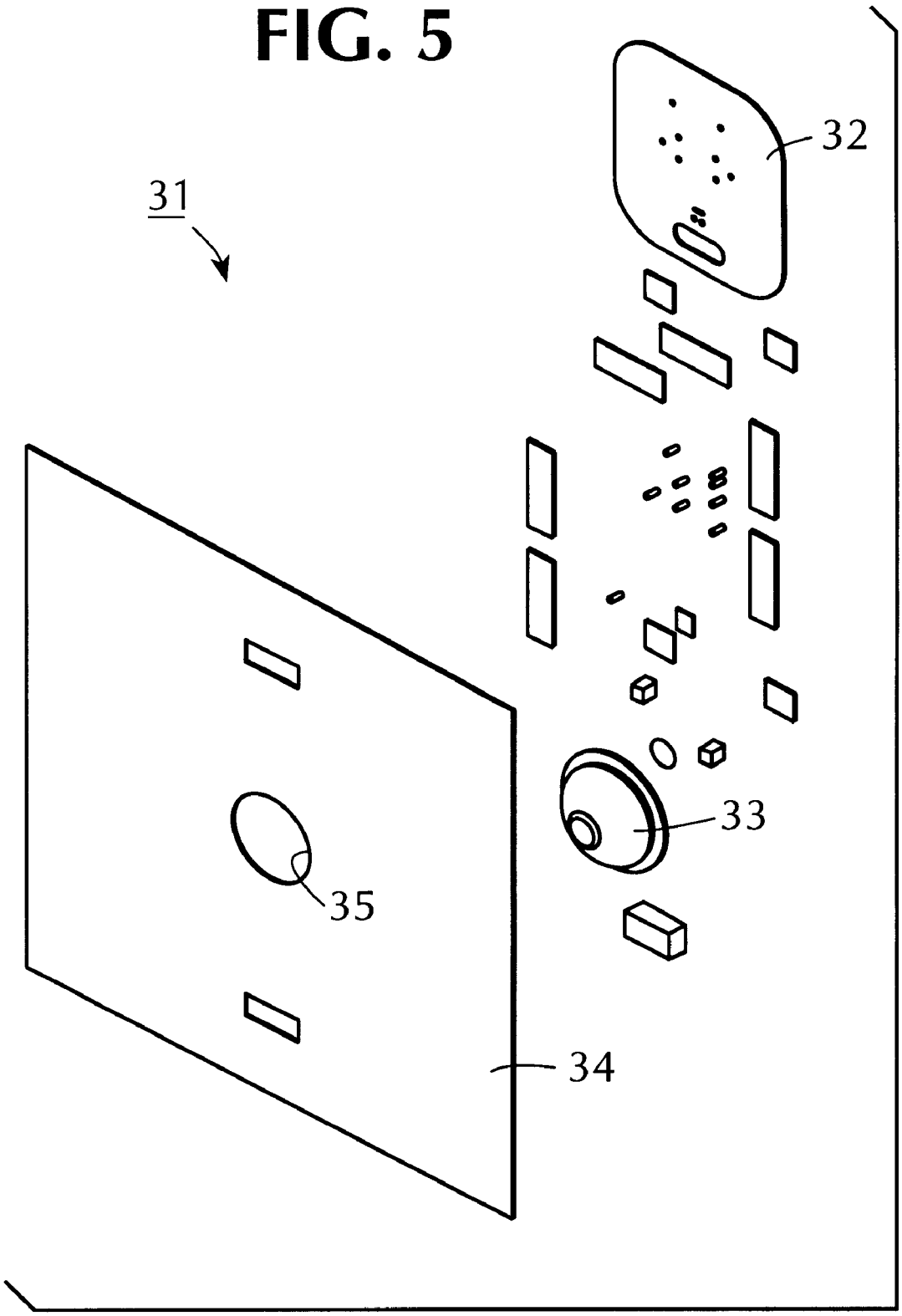
Figure 6:
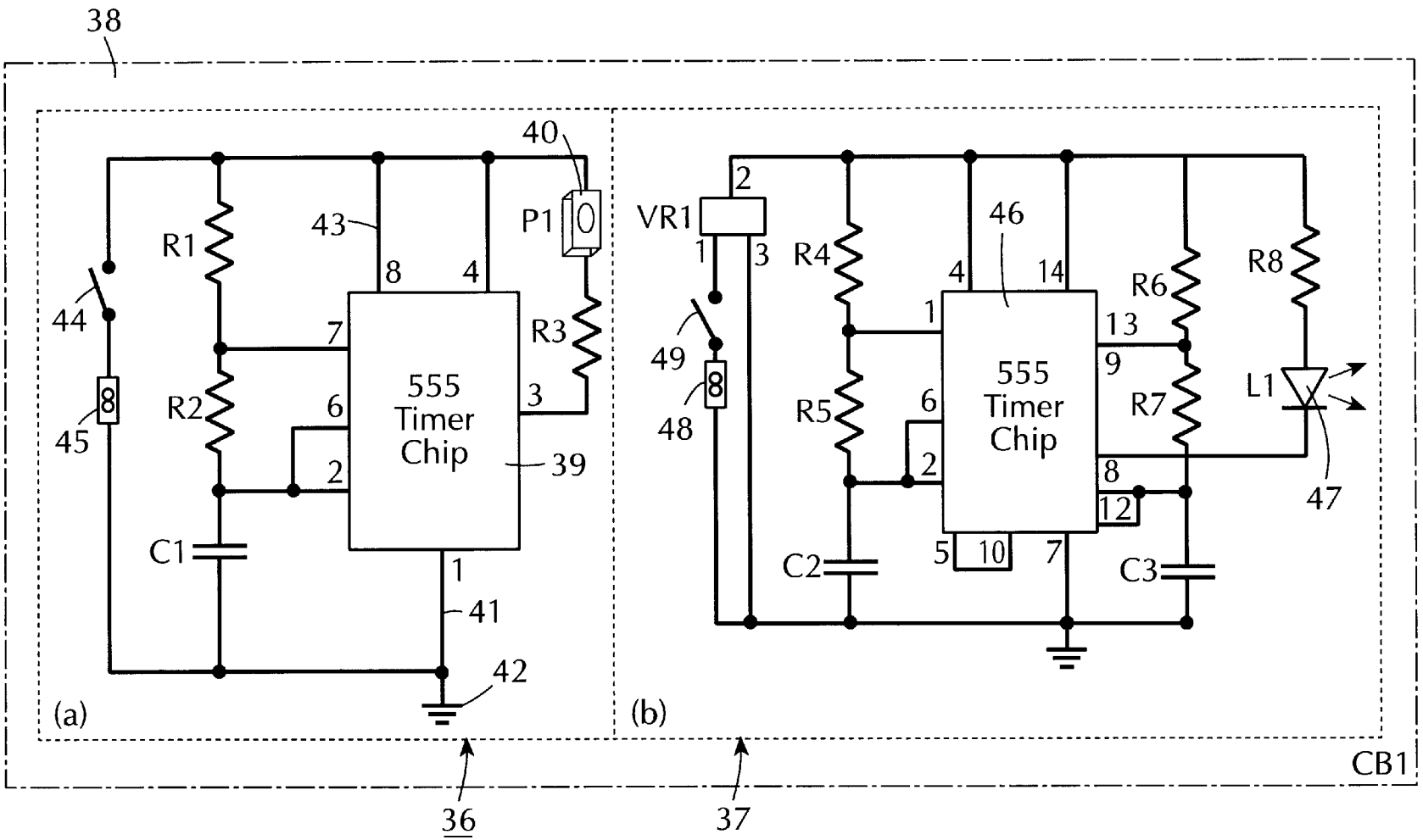
Figure 7:
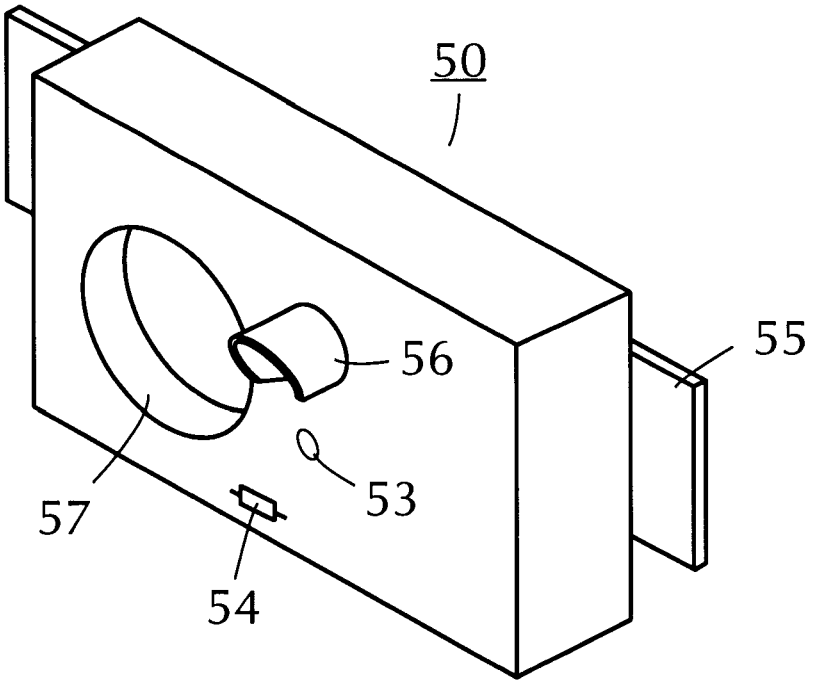
Figure 8:
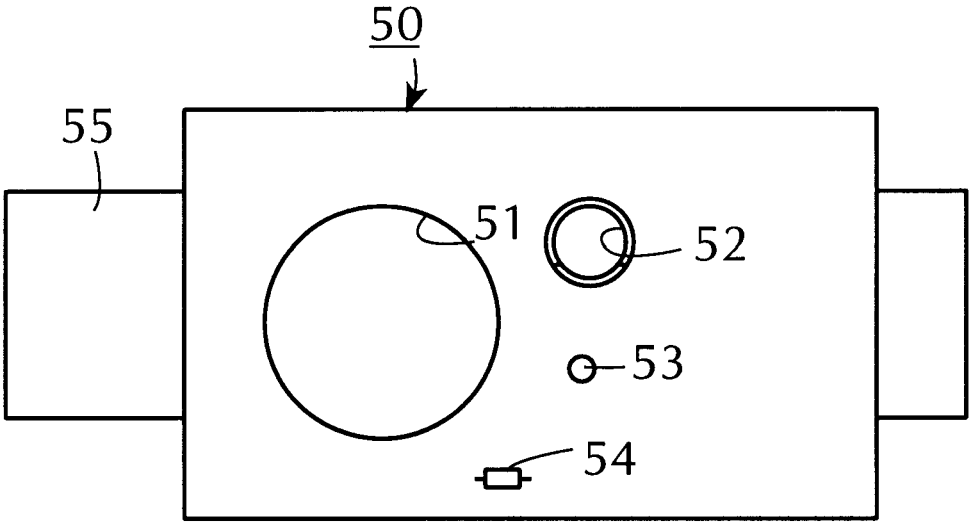
Figure 9:
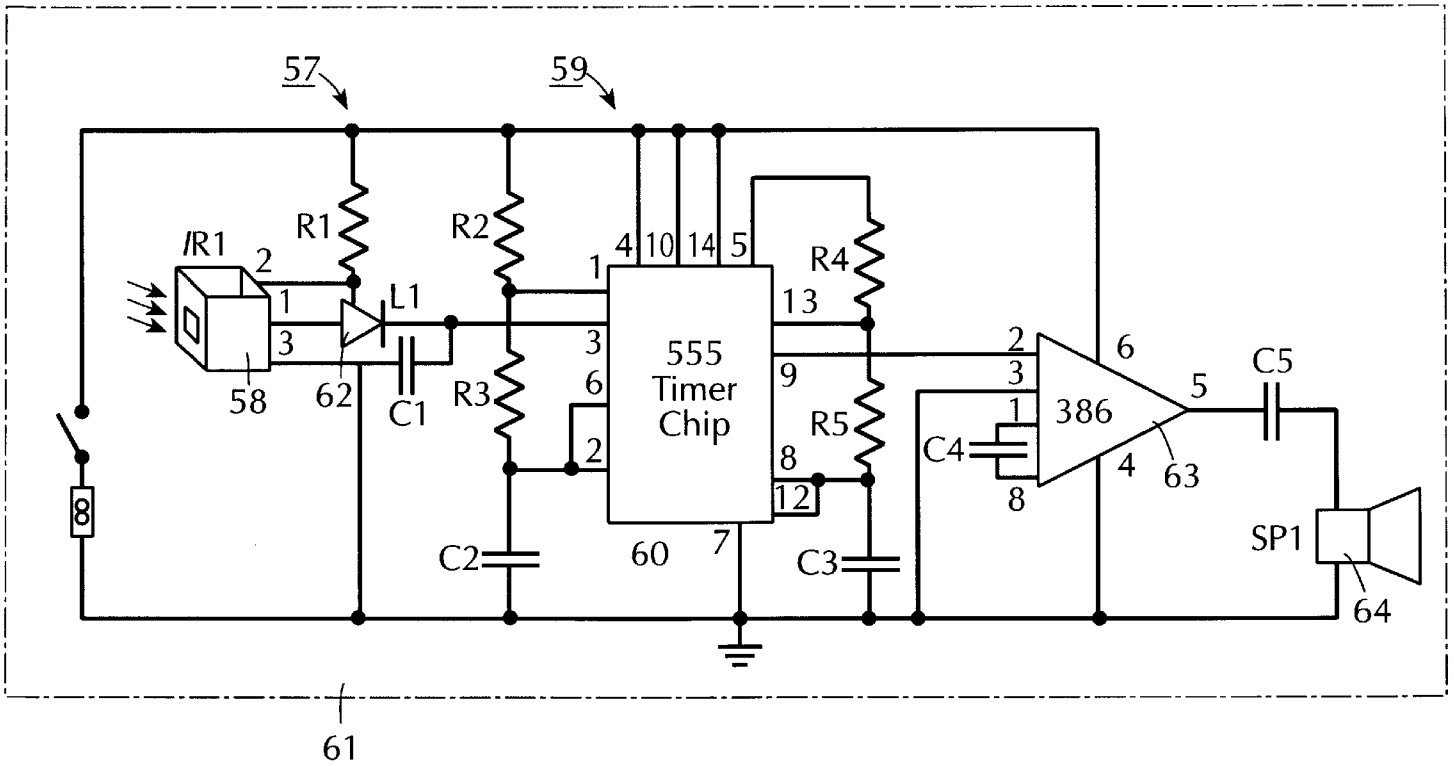
Figure 10:
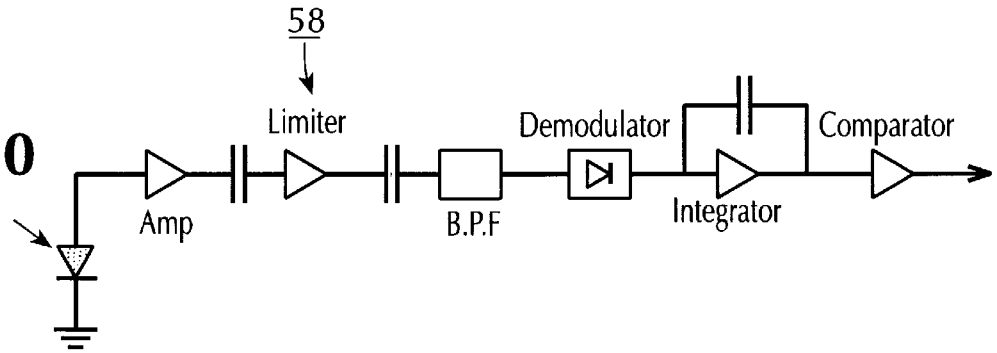

FIG. 4 schematically illustrates an electronic circuit for the device within the ball for emitting a sound signal in accordance with the invention;

FIG. 5 illustrates an exploded view of a base transmitter unit constructed in accordance with the invention;

FIG. 6 schematically illustrates an electronic circuit for the base transmitting unit constructed in accordance with the invention;

FIG. 7 illustrates a perspective view of an information unit to be mounted on a user;

FIG. 8 illustrates a front view of the information unit;

FIG. 9 schematically illustrates an electronic circuit for the information unit constructed in accordance with the invention; and FIG. 10 illustrates a block diagram of an infrared module receiver of the electronic circuit of the information unit.

Figure 1:
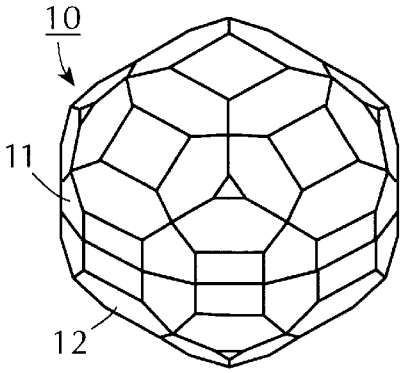
FIG. 1 illustrates a perspective view of a ball constructed in accordance with the invention.

Referring to FIG. 1, the ball 10 is made of a dense foam material suitable for kicking purposes and has a basic 16 inch spherical shape. The external surface of the ball 10 may be faceted as illustrated or smooth (not shown). The ball 10 is made of two halves 11, 12 which are held together by a pair of straps (not shown).

Figure 2:
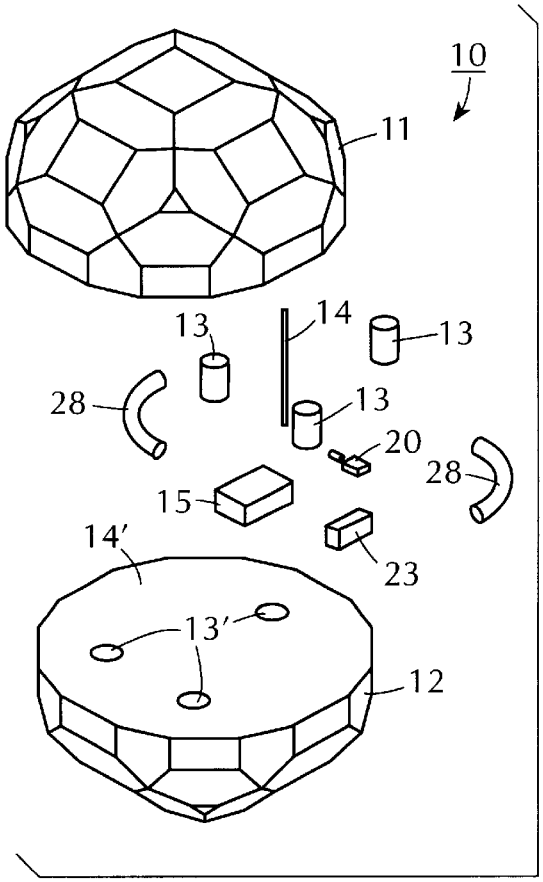
FIG. 2 illustrates an exploded view of the ball of FIG. 1.

Referring to FIG. 2, the two halves 11, 12 of the ball are guided into interfitting relation with respect to each other by means of three 2 inch PVC pipes 13 and a wooden dowel 14. Each half of the ball 10 is provided with recesses 13', 14' to receive the respective pipes 13 and dowel 14. Of note, the straps (not shown) serve to firmly hold the two halves of the ball together while allowing the ball 10 to withstand the external force of being kicked. To this end, the straps are made of a suitable elastic material to allow for deformation upon being kicked, bounced and/or thrown.

The ball 10 also includes a device 15 for emitting a sound signal which is mounted within a central recess 16 (see FIG. 3) in the top half 11 of the ball.

Referring to FIG. 4, the sound emitting device 15 houses an electronic circuit 17 for emitting the sound signal. As illustrated, the electronic circuit 17 is mounted on a circuit board 18 and includes a timer chip 19, such as a 555 Timer Chip, sold by Radio Shack under the description timer; LM 555; DIP 8, for emitting a consistent repeated sound signal of predetermined pitch and frequency. As indicated, the timer chip 19 is connected to ground and to a switch 20 which, in turn, selectively connects to a line 21 carrying a battery clip 22. Upon closing of the switch 20, a voltage from a battery 23 (see FIG. 2) connected to the battery clip 22 can be applied to the timer chip 19.

In addition, a resistance circuit is connected to the timer chip 19. As illustrated, this resistance circuit includes three resistors R1, R2*b*1, R2*b*2 and one capacitor C1 which are connected as shown.

The electronic circuit 17 also includes a speaker circuit which includes a second capacitor C2 and a pair of speakers 24 connected in parallel and mounted at opposite ends of the device 15. For simplicity, only one speaker is shown.

The electronic circuit 17 is constructed so that the timer chip 19 is able to emit a sound signal of predetermined pitch and frequency through the speakers 24.

The electronic circuit 17 is also constructed to change the sound of the signal whenever the velocity (i.e. acceleration) of the ball is dramatically altered. To this end, the circuit 17 has a secondary circuit including a fourth resistor R2*a* and a normally open second switch 25, as illustrated. The switch 25 is disposed to selectively connect the resistance R2*a* to the timer chip 19 to change the pitch and frequency of the sound signal emitted by the timer chip 19. In addition, a spring 26 is connected to the switch 25 to close the switch 25 in response to a rapid acceleration of the ball. The bias of the spring 26 is such as to otherwise maintain the switch 25 open.

Referring to FIG. 2, the switch 20 of the electronic circuit 17 is disposed within a recess 27 (FIG. 3) in the top half 11 of the ball at a point close to the external surface so that the sound signal device may be activated and deactivated when desired by a user.

As illustrated in FIG. 2, the ball is provided with a pair of symmetrically disposed tubes 28 each of which is of flexible nature and is disposed in planar form to conduct sound from a respective speaker 24 (see FIG. 4) to a point near the external surface of the ball 10.

Figure 3:
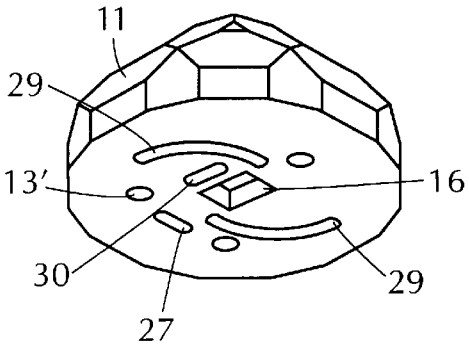
FIG. 3 illustrates a view of the underside of the top half of the ball of FIG. 1.

Referring to FIG. 3, the top half of the ball 11 is provided also with two recesses 29 to receive the tubes 27 and a recess 30 to receive the battery.

The construction of the ball 10 is such that the two halves 11, 12 can be readily separated from each other in order to provide for replacement of the battery 23 from time to time. Further, the construction of the ball is such as to readily accommodate the internal sound-making device 15 in a protective manner while simultaneously providing a ball which is sufficiently soft as to avoid injury to a player if hit by the ball during play. Also, the ball 11 is constructed so that the sound transmitting device 15 is located at the center of gravity of the ball 11.

Referring to FIG. 5, the base transmitting unit 31 includes a rectangular base 32 on which a dome shaped shell 33 is hingedly mounted. Typically, the base 31 has dimensions of 12 inches by 13¾ inches while the dome 33 has a 7½ inch diameter which rises 2 inches above the base 32. As indicated, a mat 34, for example a 3 foot square rubber mat, is provided to surround and overly the base transmitter unit 31 and includes a centrally disposed opening 35 for projection of the dome shaped shell 33 therethrough.

The base transmitting unit 31 provides the following functions:

Provides information to indicate direction of travel;

Helps positioning of the fielders;

Provides information to keep a runner in straight line; and

Test system.

These functions are accomplished in two fashions. First, the base transmitter unit 31 emits a sound that does not vary in pitch or frequency, e.g. a low slow tone, such as a 300–500 Hz tone pulsed at 2 second intervals. This tone helps the fielders to position themselves, upon entering the field, and to reposition themselves between plays. The tone also lets the runner know when he has arrived on a base, because the tone will be beeping just under the runner. The lack of a tone can also be an indicator of problems with the base transmitter unit 31.

Second, the base transmitter unit 31 emits a constant frequency infrared signal, e.g. a 38 kHz infrared signal pulsed at 16.5 Hz. This signal is aimed down the base path in reference to the direction the runner should run to arrive on the base. For example, first base is aimed towards home plate to allow a kicker to run from home plate to first base. Second base is aimed at first base and so on. The signal is used to provide the runner with the direction he must travel to arrive at that base and also keeps the runner in a straight line while he is traveling to the base.

The dome-shape shell 33 is mounted on the base 32, for example, by means of a hinge (not shown) so that the space under the shell 33 may be readily accessed. The base 32 may also be provided with rubber feet (not shown) to steady the base 32 on a hard surface such as a gymnasium floor.

The electronic circuitry for the base transmitter unit 31 is schematically illustrated in FIG. 6. In this respect, the base transmitter unit 31 has a first electronic circuit 36 for emitting the sound location signal and a second electronic circuit 37 for emitting a signal beam in a straight path from the base transmitter unit. As indicated, both circuits 36, 37 are mounted on a common circuit board 38.

The first electronic circuit 36 includes an astable 555 timer chip 39 (similar to the timer chip 19) for emitting a two second clock pulse (0.5 Hz) for driving a piezoelectric buzzer 40 which emits a pulsing frequency at a rate at which the timer chip 39 pulses. As illustrated, a current limiting resistor R3 is disposed between the timer chip 39 and the buzzer 40 to limit the current through the buzzer 40, for example to 15 miliamps (mA). Typically, the circuit 36 would operate on a 9 volt battery with minimal current draw.

As illustrated, the electronic circuit 36 includes a line 41 for connecting the timer chip 39 to ground 42 and a second line 43 which is connected to a switch 44 for connecting the timer chip 39 to a battery (not shown) via a battery clip 45. The resistance circuit employs two resistors R1, R2 and one capacitor C1, as illustrated.

The second electronic circuit 37 employs an astable light wave transmitter 46 consisting of a 556 Timer Chip. This 556 Timer Chip is actually two 555 Timer Chips combined into one and is sold by Radio Shack under the description Timer; Dual; LM 556; DIP-14. The frequency of the signal transmitted is chosen at 38 KHz and is controlled by two resistors R6, R7 and one capacitor C3, as illustrated. This frequency is pulsed at a rate controlled by a pair of resistors R4, R5 and a capacitor C2.

As illustrated, a light emitting diode 47, such as an infrared emitting diode, is connected to the timer chip 46 for emitting an infrared signal beam. As indicated, the light emitting diode 47 is disposed in a circuit with a resistor R8. The light emitting diode 47 which is used possesses the highest power rating to obtain the maximum distance of sixty feet needed to guide the runners from base to base.

The overall circuit 37 operates on a nine volt battery which is regulated by a 7805 five volt regulator VRI to provide the circuit 37 with a constant 5 volts to ensure proper operation and to keep the output signal at a maximum until the battery needs to be changed. The circuitry was chosen for the same reasons as the first electronic circuit 36 and particularly since an infrared light emitting circuit will not be subject to radio interference. Further, the circuit has a low power draw for maximum battery life.

The circuit 37 includes a battery clip 48 for the battery and a switch 49 to activate/deactivate the circuit 37.

By way of example, the various components of the two electronic circuits 36, 37 have the following values:

| | | |
|---|---|---|
| R1: 11.15M ohms | C1: 0.22 μf | L1: 900 nm infared L.E.D. |
| R2: 3.3M ohms | C2: 0.1 μf | P1: 1.5–3 v Piezo Buzzer |
| R3: 220 ohms | C3: 0.01 μf | VR1: +5 Voltage Regulator |
| R4: 3.2K ohms | | |
| R5: 678K ohmns | | |
| R6: 2K ohms | | |
| R7: 760 ohms | | |
| R8: 10 ohms | | |

Referring to FIGS. 7 and 8, the information unit 50 is in the form of a small box to be strapped around the waist of a runner for so long as the runner is playing for the offensive team. When it is time for a player to step up to kick, the unit 50 is strapped onto the player and activated. In this respect, the information unit 50 is contained within a housing weighing about two pounds with overall dimensions of 4 inches ×2½ inches by 1½ inches.

Once activated, the information unit 50 emits a constant tone signal of varying pulse frequency based on base alignment, for example, the information unit 50 emits a loud low frequency tone of 62% duty cycle, meaning that the unit 50 is on for a certain amount of time and off for a shorter amount of time. Once a player has kicked the ball and desires to run to first base, and later second, third and home, the player rotates in place until hearing the duty cycle tone increase in frequency. In other words, the player would hear tone of the unit 50 faster. In this respect, the unit 50 is then aligned with the signal beamed from the base transmitter unit 31 so that the runner can begin to run in a straight line towards the base transmitter unit 31. If the runner turns too much, the signal is lost and the frequency of the tone signal drops back to normnal.

As shown in FIG. 8, the information unit 50 is provided with a speaker aperture 51, an infrared receiver aperture 52, an LED aperture 53 and a switch 54 all in the front face. The back side of the unit 50 is provided with a mounting plate 55 which is to be attached to a suitable belt which encircles the waist of a user. In addition, an elongated tube 56 extends from the unit 50 over the aperture 52 for receiving the signal beam while blocking stray light from the aperture 52. A lens 52' is also mounted in the aperture 52 for focusing the light beam which is received.

Referring to FIG. 9, the information unit includes an electronic circuit 57 for emitting a low frequency tone signal as well as means for increasing the frequency of the tone signal in response to reception of a signal being from the base transmitter unit. This electronic circuit 57 includes a module receiver 58 for receiving the infrared signal beam and for filtering and demodulating the received signal.

As shown in FIG. 10, the module receiver 58 is constructed so that the infrared signal beam which is received is amplified, filtered and demodulated. The receiver 58 functions to produce a good clean voltage that ranges from 0.2 to 4.4 volts based upon a module Vcc of 4.3 +/−5.7 V. Such a module is similar to those found in many televisions and video cassettes recorders. Typically, these modules have center frequencies around 38–40 kHz and are designed to receive over a long distance where signal strength is variable.

After the signal beam has been received, amplified, filtered and demodulated, the resultant signal is used to control an oscillator 59 of the electronic circuit 57 (see FIG. 9). As schematically illustrated, the oscillator 59 includes a 556 Timer Chip 60 which is mounted on a circuit board 61 housed within the information unit 50 (see FIG. 7).

As shown in FIG. 9, a light emitting diode 62 is connected to the module receiver 58 so as to emit a light through the aperture 53 (see FIG. 8) of the information unit 50. While the incoming signal is received, a capacitor C1 charges. As the signal is lost, the capacitor C1 discharges and throttles down the control voltage. The diode 62 also ensures a desired discharge path. Typically, while the carrier frequency is received the diode 62 will flash.

The 556 Timer Chip 60 is sold by Radio Shack under the description Timer; Dual; LM556; DIP-14. Such a chip 60 contains two timers and is configured to have a steady tone of 400–600 Hz with a tone output at a 50% duty cycle. In the given example, the Timer Chip 60 is an astable pulse oscillator that emits a 480 Hz tone at a frequency of 0.73 Hz for a duty cycle of 62%. By feeding the output voltage level of the level converter formed by the diode 62 and capacitor C1 into the control voltage pin (not shown) of the timer chip 60, a voltage controlled oscillator 59 is created. Thus, an oscillator 59 is obtained that increases the output frequency of the audible tone as a base transmission is received.

As illustrated in FIG. 9, a LM 386 audio amplifier 63 is used in the electronic circuit 57 in order to obtain the loudest possible output volume so that every player on the field is able to hear the output. As illustrated, a capacitor C4 is connected across pins 1 and 8 of the amplifier 63 to achieve a gain of 200. This is to maximize the output to the maximum of 325 mW.

As also shown in FIG. 9, a speaker 64 is electronically connected with the amplifier 63 over a further capacitor C5.

The electronic circuit 57 is constructed so that the total power consumed is 1 watt. Thus, a 9 volt battery can be a very suitable power source.

By way of example, the parameters used for the various components of the electronic circuit 55 are as follows:

| Resistances | Capacitors |
|---|---|
| R1: 2.2K ohms | C1: 10 μf |
| R2: 100K ohms | C2: 4.7 μf |
| R3: 160K ohms | C3: 0.1 μf |
| R4: 10K ohms | C4: 10 μf |
| R5: 10K ohms | C5: 47 μf |

The invention thus provides an information delivery system with three relatively simple and inexpensive components which will permit visually impaired people to play kick ball and similar games.

The invention also provides a ball that may be used other than as a kick ball. For example, visually impaired people may simply toss or kick the ball back and forth. Likewise, the components of the system may be used other than as described above for other orientation purposes.

A typical set of instructions for playing kick ball with the components of the information delivery system may be as follows:

1. Operating the Ball Electronics:
   a) Turning On:
      i) Make sure there is a functional 9 volt battery connected to the battery clip.
      ii) Push the switch once.
      iii) The ball should emit sound.
   b) Turning Off:
      i) Push the switch once.
      ii) The ball should stop emitting sound.
2. Instructions for Using the Base Transmitter Unit (BTU):
   a) Sighted people are required to set up the system. The first stands at home plate with the runner information unit (RIU) while the second takes the three bases and positions them in the playing field. First base is placed into its proper position with the handle and silver dome carefully placed facing upward. The person at home plate turns on the RIU and checks for the pulsed tone. The person at first base turns on the infrared transmitter in the base. The RIU when pointed toward first base should begin beeping rapidly. If this rapid beeping sound is not heard, the person at first base should rotate the base 45 degrees, first right and then left, to allow for proper contact between the two devices. Once properly aligned the individual should check for a low, slow 300 to 500 hertz (Hz) pulsing tone, which should be generated from the base. This sound, which is distinctly different from that generated by the RIU, can be used by players to help them locate the bases.
   b) Once the base has been successfully put into operation, the 3 foot square rubber mat should be placed over the base with the dome protruding up through the hole in the middle of the mat. First base is now ready for use.
   c) The person with the RIU now proceeds to first base while the person on first base proceeds to second base and the entire activation procedure is repeated, this time for second base.
   d) Once all bases are put into operation, the game can begin.
   e) Upon completion of the game, a sighted person must proceed around the bases, turn them off, and collect all components for storage.
3. Instructions on Use of the Runner Information Unit (RIU):
   a) Introduction
      i) The Runner Information Unit (RIU) is a homing device used to assist visually impaired kickball players in locating key destinations on the kickball field. Kickball requires players to move down preset baselines to the desired bases. This movement normally is based on the use of an incredible amount of visual information, which is integrated by the player and used to assist in making movement decisions. The RIU is designed to work with the Base Transmitter Unit (BTU) to convert visual information into audible information for use by visually impaired players.

ii) The RIU, when turned on, emits a loud intermittent tone, e.g. at one second intervals. Bases on the kickball field are equipped with transmitters, which send out an infrared signal that can be detected by the RIU. When the RIU is in line with the signal from a base transmitter, its output tone is programmed to increase in frequency. This change in the signal lets the runner know that he is pointing in the direction of the base and should start to run in that direction. If at any point the runner loses the signal, the RIU will return to its regular frequency and the runner will immediately know that he must change position to re-align with the base.

b) Putting the RIU on:

i) When the player is ready to kick, an RIU is strapped onto his waist and positioned in the direction of forward movement.

c) Turning on the RIU:

i) Once properly positioned, the PJU should be turned on by sliding the switch located on the face of the unit in the middle area of the device. The switch should be moved to the right to activate the unit. Upon turning on the power, the pulsed sound of the RIU should immediately be heard.

d) Positioning to Kick:

i) The player should locate home plate using the base location tone and should directly face the pitcher who has the buzzing ball, if the ball is being pitched, or second base if not. When the player is ready, the ball will be pitched (if applicable) and the player will attempt to propel it into the field.

e) Running to the Base:

i) Once the player has kicked the ball, he/she should quickly rotate until the RIU locks on to the transmitted signal beam of the base. The player should immediately move forward as rapidly as possible—the goal of the other team is to get the ball to the base the player is running toward while in movement before he reaches the base. If at any point while moving toward the base, the player loses the base signal, he/she should pause for a moment, rotate, and re-identify the correct direction to run.

f) Approaching the Base:

i) Three mechanisms are available to allow the player to recognize close proximity to the base:

(1) The sound of the location tone of the base should be prominent (2) The mat at the base can be felt by the runner (3) The RIU will suddenly lose its signal.

ii) When these three cues are apparent, the runner knows he/she has reached the base.

g) Once on base:

i) Once the player has reached the first base, he/she should identify the position of the second base and again move forward.

h) Done:

i) Once the player has completely rounded all bases, the team has scored. The player should shut the RIU off and give it to the next runner. Typically, four RIUs would be provided for playing the game.

The invention thus provides a system which will enable visually impaired persons to participate in sports not otherwise available to them.

The invention further provides a system which uses a compact information unit which can be readily worn by a user as well as various components which emit different sound signals which can be readily distinguished one from the other in order to participate in a game.

What is claimed is:

1. A ball apparatus in combination comprising a ball having an internally disposed device for emitting a sound signal to provide means for locating said ball;

a base transmitter unit having a first electronic circuit for emitting a sound location signal, wherein said base sound signal provides means for orientation, and a second electronic circuit for emitting a second signal from said base transmitter unit; and an information unit to be mounted on a person, said information unit having an electronic circuit for emitting a pulsed sound signal for all players in a game to hear and including means for changing the pulse frequency of said pulse sound signal in response to receiving said second signal from said base transmitter unit.

2. The combination as set forth in claim 1 wherein said ball is made of foam material.

3. The combination as set forth in claim 1 wherein said device in said ball includes an electronic circuit for emitting said sound signal.

4. The combination as set forth in claim 3 wherein said device is disposed centrally within said ball and which further comprises a pair of symmetrically disposed tubes within said ball, each said tube extending from said device towards an exterior surface of said ball for transmitting said sound signal from said device to said exterior surface of said ball.

5. The combination as set forth in claim 3 wherein said electronic circuit includes a timer chip for emitting a consistent repeated sound signal of predetermined pitch and frequency, a resistance, a switch for selectively connecting said resistance to said timer chip to change the pitch of said sound signal, and a spring connected to said switch to close said switch to connect said resistance to said timer chip in response to a rapid acceleration of said ball.

6. The combination as set forth in claim 1 which further comprises a switch within said ball for activating and de-activating said device.

7. The combination as set forth in claim 1 wherein said location signal of said base transmitter unit is a pulsing tone.

8. The combination as set forth in claim 1 wherein said second electronic circuit of said base transmitter unit includes a light emitting diode for emitting said second signal in said path.

9. The combination as set forth in claim 8 wherein said second signal is an infrared light beam.

10. The combination as set forth in claim 1 wherein said base transmitter unit includes a dome-shaped shell housing said first and second electronic circuits of said unit.

11. The combination as set forth in claim 10 which further comprises a mat surrounding and overlying said base transmitter unit having a centrally disposed opening for projection of said shell therethrough.

12. The combination as set forth in claim 1 wherein said electronic circuit of said information unit includes an oscillator for generating a tone signal.

13. The combination as set forth in claim 12 wherein said means of said information unit includes a receiver for receiving said signal from said base transmitting unit and emitting a demodulated signal in response thereto to said oscillator to change the pulse frequency of said tone signal.

14. The combination as set forth in claim 13 wherein said information unit includes an amplifier connected to said oscillator to amplify said tone from said oscillator and a speaker connected to said amplifier to emit said amplified tone.

15. The combination as set forth in claim 1 wherein said second electronic circuit of said base transmitter unit includes a light emitting diode for emitting an infrared signal and wherein said means of said information unit includes a receiver for receiving said signal beam from said base and emitting a demodulated signal in response thereto to said oscillator to change the pulse frequency of said tone signal.

16. A ball apparatus in combination comprising a base transmitter unit having a first electronic circuit for emitting a sound location signal wherein said base sound signal provides means for orientation and a second electronic circuit for emitting a second signal from said base transmitter unit; and an information unit to be mounted on a person, said information unit having an electronic circuit for emitting a pulsed tone signal for all players in a game to hear and including means for changing the frequency of said tone signal in response to reception of said second signal from said base transmitter unit.

17. The combination as set forth in claim 16 wherein said location signal of said base transmitter unit is a pulsing tone.

18. The combination as set forth in claim 16 wherein said second electronic circuit of said base transmitter unit includes a light emitting diode for emitting said signal.

19. The combination as set forth in claim 18 wherein said second signal is an infrared light.

20. The combination as set forth in claim 18 wherein said first electronic circuit of said information unit includes an oscillator for generating a tone signal.

21. The combination as set forth in claim 20 wherein said means of said information unit includes a receiver for receiving said signal from said base transmitting unit and emitting a demodulated signal in response thereto to said oscillator to change the pulse frequency of said tone signal.

22. The combination as set forth in claim 21 wherein said information unit includes an amplifier connected to said oscillator to amplify said tone from said oscillator and a speaker connected to said amplifier to emit said amplified tone.

23. The combination as set forth in claim 16 wherein said second electronic circuit of said base transmitter unit includes a light emitting diode for emitting an infrared signal beam in said path and wherein said means of said information unit includes a receiver for receiving said signal beam from said base transmitting unit and emitting a demodulated signal in response thereto to said oscillator to change the pulse frequency of said tone signal.

* * * * *